United States Patent [19]

Hirano et al.

[11] 4,299,721

[45] Nov. 10, 1981

[54] METHOD OF AND APPARATUS FOR PRODUCING RADIO-ACTIVE WASTE PACKAGE

[75] Inventors: Mikio Hirano; Susumu Horiuchi, both of Hitachi, Japan

[73] Assignee: Hitachi, Ltd., Tokyo, Japan

[21] Appl. No.: 964,819

[22] Filed: Nov. 30, 1978

[30] Foreign Application Priority Data

Dec. 2, 1977 [JP] Japan ..... 52-143884

[51] Int. Cl.[3] ..... G21F 9/16

[52] U.S. Cl. ..... 252/628; 422/903; 425/140; 425/147; 425/174.4; 425/258

[58] Field of Search ..... 252/301.1 W; 250/506, 250/507; 422/159, 903; 425/140, 147, 174.4, 258

[56] References Cited

U.S. PATENT DOCUMENTS 4,139,488 2/1979 Knotik et al. ..... 252/301.1 W

FOREIGN PATENT DOCUMENTS 2546428 4/1977 Fed. Rep. of Germany ..... 176/37
2304995 3/1976 France ..... 252/301.1 W
50-69500 6/1975 Japan ..... 252/301.1 W
52-34200 3/1977 Japan .
52/155000 12/1977 Japan .

*Primary Examiner*—Deborah L. Kyle
*Attorney, Agent, or Firm*—Craig and Antonelli

[57] ABSTRACT

Provided is a method of producing radio-active waste package. By evaporating and drying, the radio-active waste is reduced to a radio-active powder which is formed into pellets in order to ease its disposal. The pellets are received in a container and then impregnated therein with a thermoplastic composition so as to be integrally solidify in the container. The prior technical method cannot fully impregnate the pellets with the thermoplastic material. The present invention improves the prior art technical method of producing radio-active waste package thereby to eliminate the above disadvantage. The present invention also provides a device for carrying out the above method.

14 Claims, 5 Drawing Figures

METHOD OF AND APPARATUS FOR PRODUCING RADIO-ACTIVE WASTE PACKAGE

BACKGROUND OF THE INVENTION

The present invention relates to a disposal of radio-active wastes and, more particularly, to a method of producing radio-active waste package which affords a safe disposal of the radio active wastes to the natural environment. The invention is further concerned with an apparatus for producing the above-mentioned radio-active waste package.

The radio-active wastes from boiling water reactors (BWR) nuclear power station or the like plants are stored in a shielded container over a predetermined period, in order to attenuate the radio-activity. The total volume to be stored is impractically large, because the waste of this kind is in the liquid state. It is therefore a common measure to solidify the liquid waste.

A practical method for solidifying the liquid waste is to fill a vessel with the radio-active waste liquid, and evaporating the water content so as to solidify the radio-active waste in the vessel. This method, however, can provide only a small efficiency of use of the vessel, because the radio-active waste after the solidification occupies only a small part of the volume in the vessel, even when the vessel is completely filled with the liquid waste before the solidification.

It is also proposed and practised to fill each vessel completely full with separately solidified radio-active waste. In order to obtain a radio-active waste package which can be disposed to natural environment after a storage over a predetermined period, it is necessary to adjust the amount of the radio-active waste such that the requirement of regulation for final disposal of radio-active waste is fully met. Such an adjustment is difficult especially when the radio-active waste is in the liquid state.

To overcome above-stated problems, Japanese Patent Laid-Open Publication No. 34200/1977 discloses the formation of pellets from the radio-active waste after the solidification. More specifically, in this Patent Laid-Open Publication, disclosed is a method for disposing of the radio-active waste comprising the steps of evaporating the radio-active waste liquid in a membrane type evaporator, forming pellets from the powders of radio-active waste obtained in said evaporator, and storing the pellets in a storage tank having a shielding construction. This proposed method considerably facilitates the adjustment of the amount of radio-active waste for fulfilling the regulation for the final disposal.

As a method of preparing a radio-active waste package which can be disposed to the natural environment, Japanese Patent Laid-Open Publication No. 85699/1977 discloses a method in which a drum is filled with the radio-active waste together with an asphalt material. In this package, the drum is provided at its central portion with a cage in which pellets of the radio-active waste are to be disposed, while the space surrounding the cage is adapted to be filled with the asphalt material.

This method, however, is still insufficient in that the mechanical strength of the package is not strong enough and, therefore, the package is liable to be damaged or broken when disposed to the natural environment, because the block of the pellets cannot be sufficiently impregnated with the asphalt material by a mere filling of the drum with the asphalt material. This problem of lack of strength of the radio-active waste package is serious especially when the packages are bound for offshore disposal.

SUMMARY OF THE INVENTION

It is therefore a major object of the invention to eliminate the problems or shortcomings of the conventional radio-active waste package.

To this end, according to the invention, there is provided a method of producing a radio-active waste package comprising the steps of filling a container with a predetermined amount of pellets of the radio-active waste, filling the container with a thermoplastic composition in the molten state while heating the container, heating the container over a predetermined period, cooling the container, filling again the container with the molten thermoplastic composition, and then sealingly fitting a lid member to the container.

In the preferred embodiment of the invention, an asphalt material is used as the thermoplastic composition.

At the same time, in the preferred embodiment, the temperature to which the pellets of the radio-active waste and the container are heated is about 160° C., and the heating time is about 1 hour. A test showed that the block of the pellets is satisfactorily impregnated with the asphalt material, when the drum filled with the pellets of the radio-active waste and then with the molten asphalt is heated to and held at an elevated temperature of 160° C.

The radio-active waste package produced by the method of the invention, sufficiently impregnated with the thermoplastic material, exhibits a large strength enough to withstand any external force which may exerted on the package when it is subjected to an offshore or other natural environmental disposal.

The above and other objects, as well as advantageous features of the invention will become more clear from the following description of the preferred embodiment taken in conjunction with the accompanying drawings.

DESCRIPTION OF THE PREFERRED EMBODIMENTS

Before turning to the description of the invention in the form of an embodiment, a method of producing radio-active waste package from a radio-active waste, as well as the construction of a radio-active waste package suitable for a disposal to natural environment, will be described with specific reference to FIGS. 1 and 2.

Figure 1:
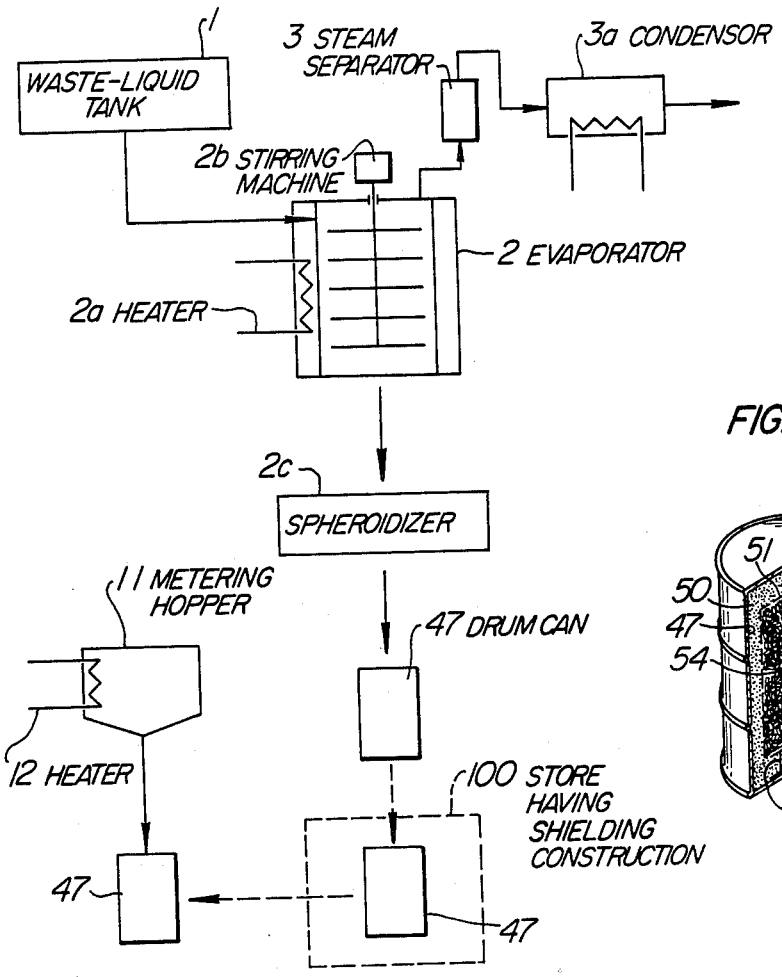
FIG. 1 is an illustration of steps of a process for producing a radio-active waste package from a radio-active waste.

Referring first to FIG. 1 which shows an outline of the method for producing radio-active waste package a waste-liquid tank containing a radio-active waste is designated at a reference numeral 1. A centrifugal membrane type evaporator 2 has a heater 2*a* for heating the inner peripheral wall thereof. A steam separator 3 is adapted to separate the particles included by the steam generated by the centrifugal membrane type evaporator 2. Reference numerals 3*a*, 2*b* and 2*c* denote, respectively, a condenser, a stirring machine for scraping solidified matter from the inner wall of the centrifugal membrane type evaporator 2 and a spheroidizer adapted to form the solidified material in the centrifugal membrane type evaporator 2 into pellets of predetermined shape and size. The formed pellets are received by a drum 47, which is conveyed to a store 100 having a shielding construction so as to be store over a predetermined period, until the radio-activity is sufficiently attenuated.

Subsequently, the amount of the pellets in the drum 47 is suitably adjusted, and the drum 47 is filled with an asphalt material which is melted in a metering hopper 11 having a heater 12 so as to form a radio-active waste package ready for the disposal to natural environment.

Figure 2:
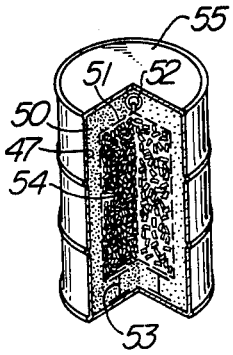
FIG. 2 is a constructional drawing of the radio-active waste package, partly cut-away to show the internal structure.

FIG. 2 is an illustration of a radio-active waste package as obtained in the final step of the production, with a part thereof cut away. Reference numerals 50 and 51 denote, respectively, an asphalt material and a cage loaded with pellets 54 of radio-active waste. The cage 51 is provided for correctly locating the pellets 54 in the central portion of the drum 47 before the asphalt material 50 is charged into the latter, and is adapted to be situated in the drum 47 by means of a suspension ring 52 which is grasped by a crane or the like lifting means. A support 53 is provided on the bottom of the drum 47 so that the cage 51 may be carried directly by the bottom of the drum 47 through the support 53. A lid member 55 is adapted to be sealingly fitted to the drum 47.

Figure 3:
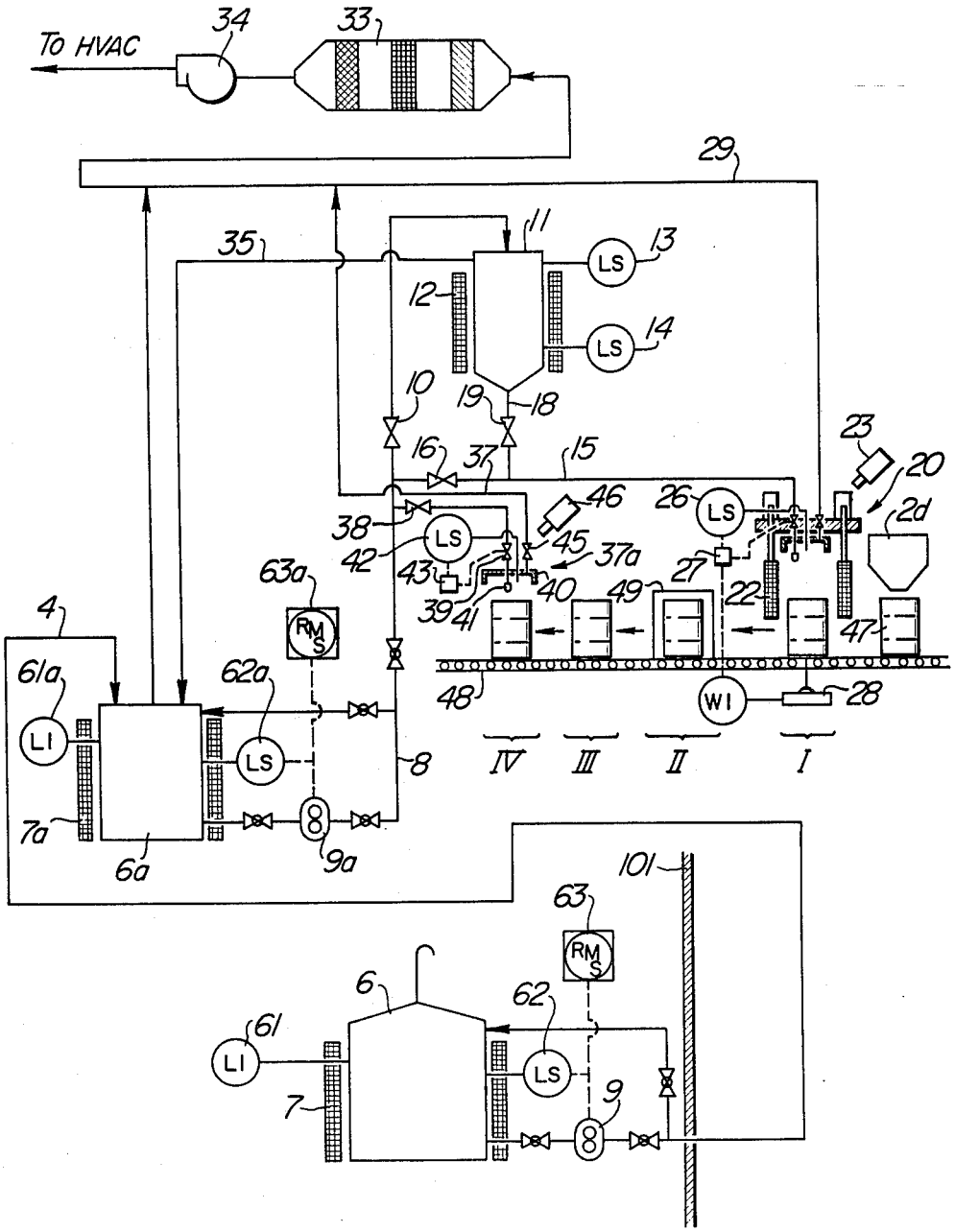
FIG. 3 is a schematic illustration showing the whole part of an embodiment of the invention.

Hereinafter, a detailed process for producing radio-active waste package in accordance with the present invention will be described with reference to FIGS. 3 to 5.

An asphalt storage tank 6 is situated outside of a building 101 having a shielding construction. The asphalt storage tank 6 has a heater 7 for heating and melting the asphalt stored therein. The molten asphalt is transferred by a pump 9, through a pipe 4, to a service tank 6*a* provided in the building 101. This service tank 6*a* also has a heater 7*a*. The storage tank 6 and the service tank 6*a* have level indicators 61, 61*a* and level switches 62, 62*a*. The level switches 62, 62*a* are adapted to perform on-off controls of the motors 63, 63*a* of pumps 9, 9*a* upon detection of the minimum molten asphalt levels in respective tanks. The molten asphalt in the service tank 6*a* is delivered to a metering hopper 11, through a pipe 8 and a valve 10 by means of the pump 9*a*.

The metering hopper 11 is provided with a heater 12 and level switches 13, 14. The metering hopper 11 is communicated with the service tank 6*a* also by means of an overflow pipe 35. A pipe 18 is connected to the bottom of the metering hopper 11. The molten asphalt coming from the metering hopper 11 is transferred to an asphalt charging device 20 through the pipe 18, a valve 19 and a pipe 15. The pipe 15 is connected also to the portion of the pipe 8 upstream from the valve 10 through a valve 16. Thus, the arrangement is such that the asphalt coming from the service tank 6 is delivered directly to the asphalt charging device 20, by-passing the metering hopper 11, when the valve 16 is opened. This arrangement is advantageous in that the asphalt can safely be fed to the asphalt charging device 20, even in case of a trouble in the latter.

Further, a pipe 37 is connected to a portion of the pipe 10 upstream from the valve 10 through a valve 38. The pipe 37 is connected to an additional charging device 37*a*.

Figure 4:
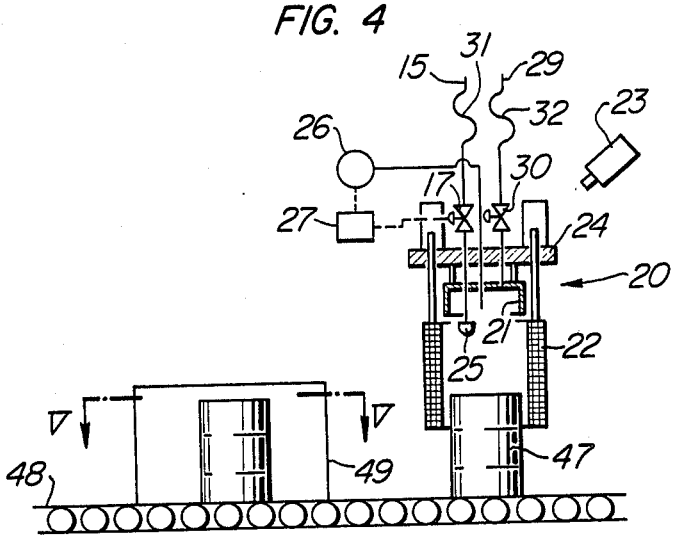
FIGS. 4 and 5 are drawings showing details of respective parts of FIG. 3.
Figure 5:
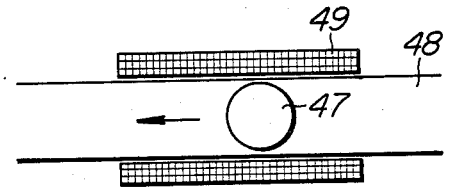

FIG. 4 shows the asphalt charging device 20 in more detail. As will be seen from this Figure, the asphalt charging device has a nozzle 25, a cover 21, a cylindrical low-frequency heater 22 and a lifting means 24. The nozzle 25, the cover 21 and the low-frequency heater 22 are carried by the lifting means 24 so as to be moved up and down by the latter.

The nozzle 25 is connected to the pipe 15 through a valve 17 and a flexible duct 31. The sensing end of a level switch 26 projects downwardly from the cover 21. The level switch 26 is electrically connected to a controller 27 which in turn is electrically connected to the valve 17. Further, a vent pipe 29 is connected to the cover 21, through a flexible duct. The vent pipe 29 is in communication with a filter unit 33 through a valve 30. A blower 34 is provided on the discharge side of a filter unit 33. The vent pipe 29 is further coupled to a vent pipe 36 which is connected to an upper portion of the service tank 6.

The additional charging device 37*a* has a construction similar to that of the asphalt charging device 20. The pipe 37 is connected to a nozzle 41 through a flexible duct (not shown) and a valve 39. The sensing end of a level switch 42 projects downwardly from the lower end of the cover 40. The level switch 42 is electrically connected to a controller 43 which in turn is connected electrically to the valve 39. A vent pipe 44, which is also connected to the vent pipe 29, is coupled to the cover 40 through the valve 45 and a flexible duct (not shown).

A conveyor 48 for transferring the drum 47 is disposed below the asphalt charging device 20. As will be clearly understood from FIG. 5, low-frequency heaters 49 are disposed on both sides of the conveyor 48, so as to oppose to each other, on the left-hand side of the asphalt charging device 20. A weighing device 28 is disposed below the conveyor 48, in alignment with the asphalt charging device 20. The weighing device 28 is electrically connected to the controller 27.

Hereinafter, the operation of the apparatus of this embodiment having the described construction will be described. The asphalt in the asphalt storage tank 6 is heated and molten by means of the heater 7. As the pump 9 is driven, the asphalt in the storage tank 6 is shifted to the service tank 6*a*, through the pipe 14. The asphalt in the service tank 6*a* is kept in the molten state, because it is heated by the heater 7*a*. Then, as the pump 9*a* is started, the molten asphalt is introduced into the metering hopper 11 through the pipe 8.

When the asphalt is delivered to the metering hopper 11 at an excessively large rate, the surplus asphalt is returned to the service tank 6*a* through the overflow pipe 35. In this state, the valve 10 is kept opened, while the valves 16 and 38 are kept closed. The level of the molten asphalt in the metering hopper 11 is continuously detected. As a later-mentioned predetermined level of the molten asphalt is reached, the valve 10 is closed and the pump 9*a* is stopped.

Meanwhile, the cage 51 (See FIG. 2) of the drum 47 is filled, through a metering hopper 2*d*, with pellets 54 of the radio-active waste. The pellets 54 have been stored in a storage station 100 having a shielding construction, until the radio-activity is sufficiently attenuated.

The drum 47 filled with pellets is conveyed to an asphalt charging station I by means of the conveyor 48.

As the drum 47 reaches a predetermined position in the station I, the conveyor 48 is stopped and then the lifting means 24 is lowered to lower the cover 21 so as to cover the top of the drum 47. At the same time, the low-frequency heater 22 comes to surround the drum 47.

Then, as the low-frequency heater 22 is energized, the drum 47 is heated by the action of a low-frequency wave. The hopper 11 contains a predetermined amount of asphalt for filling the drum 47. As the valves 19 and 17 are opened, the asphalt in the hopper 11 flows down through the pipe 15 and is poured through the nozzle 25 into the drum 47 which has been heated up to a high temperature, typically about 160° C. During this pouring, the molten asphalt is conveniently prevented from scattering, due to the provision of the cover 21 closely fitted to the upper end of the drum 47. Then, the valve 30 is opened and the blower 34 is started.

The gas expelled from the drum 47 is forced to flow to the filter unit 33 through the vent pipe 29. As the drum 47 is filled with a predetermined amount of molten asphalt, e.g. up to its lower end brim, the valves 17 and 19 are closed. More specifically, the level of the molten asphalt in the drum 47 is detected by the level switch 26. When the predetermined level is reached, the level switch 26 actuates the controller 27 which in turn acts to close the valves 17 and 19, thereby to stop the supply of the molten asphalt to the drum 47. The weighing means 28 is provided to function as a supplementary means for detecting the predetermined amount of content of the drum 47, through measuring the weight of the latter.

Then, as the filling of the drum 47 with the asphalt is over, the lifting means 24 is lifted to move the cover 21 and the low-frequency heater 22 upward. At this time, the lower end of the low-frequency heater 22 is positioned above the upper end of the drum 47. The up and downward movement of the lifting means, as well as the state in which the molten asphalt is poured is monitored by means of a TV camera 23. The lifting and lowering of the cover 21 and its associated members can be made smoothly without substantial resistance, because of the provision of flexible portions 31 and 32.

The flowing-out of the molten asphalt from the hopper 11 is detected by means of the level switch 14. Then, the valve 19 is closed, and the valve 10 is opened. Simultaneously, the pump 9*a* is started to refill the hopper 11 with the molten asphalt.

As the filling of the drum 47 with the molten asphalt is over, the conveyor 48 is actuated again to move the drum 47, which is now filled with the molten asphalt, to a heating station II. At the same time, by this movement of the conveyor 48, the next drum 47, which is to be filled with the molten asphalt, is brought to the asphalt charging station I.

In the heating station II, the drum 47 is moved along a path between the opposing low-frequency heater 49 so as to be heated and held at an elevated temperature. During this heating, the asphalt in the drum 47 is held at the elevated temperature of about 160° C. The heating time is about 1 hour.

It will be seen that the pellets 54 are sufficiently impregnated with the molten asphalt while they stay in the heating station II.

Subsequently, the drum 47 is conveyed to a natural cooling station III, where the drum can is left over about 24 hours for natural cooling. Consequently, the asphalt in the drum 47 cooled and solidified. A vacant space is formed above the solidified asphalt in the drum 47, as a result of the solidification of the asphalt.

The drum 47 is further conveyed to an additional asphalt charging station IV. As the drum 47 reaches the predetermined position in the station IV, the additional charging device 37*a* is lowered to bring the cover 40 into a tight contact with the upper end brim of the drum 47. Then, the valves 38 and 39 are opened, and the pump 9*a* is started, so as to additionally charge the molten asphalt thereby to fill the space formed in the upper portion of the drum 47. The gas in the drum 47 is expelled and delivered to a filter unit through a vent pipe 44. In this state, the valve 45 is kept opened, while the valve 10 is closed. The degree of filling of the drum 47 with the asphalt is detected by the level switch 42. As the drum 47 is refilled, i.e. as the space formed in the upper portion of the drum 47 during the natural cooling in the station III is completely filled with the additionally poured asphalt, the level switch delivers a signal to the controller 43 which in turn acts to close the valve 39. The pump 9*a* is stopped simultaneously. Then, the additional asphalt charging device 37*a* is lifted. The up and downward stroking of the device 37*a* is continuously monitored through a TV camera 46. Finally, the lid member 55 is sealingly fitted to the drum 47 transferred from the additional asphalt charging station and filled completely with the asphalt, thus completing the production of the radio-active waste package filled with asphalt.

The package obtained by a simple operation of heating the drum filled with the asphalt and holding the same at an elevated temperature exhibits a large strength against impact, because the pellets are well impregnated with the asphalt. At the same time, the leaching characteristic is considerably improved.

Although the invention has been described through specific form of embodiment, such an embodiment is not exclusive and various changes and modifications may be imparted thereto without departing from the scope of the invention which is limited solely by the appended claims.

For instance, instead of heating the drum 47 and the pellets 54 by the low-frequency heater 22 in the asphalt charging station I, as in the described embodiment, it is possible to heat them previously up to the required temperature, in advance to the first charge of the molten asphalt in the asphalt charging station I.

We claim:

1. In a method of producing a radio-active waste package, comprising the steps of radio-active powder by evaporating and drying radio-active waste to form a radioactive powder, forming pellets from said radioactive powder, receiving said pellets in a container, heating said container up to a predetermined temperature, filling said container with a thermoplastic composition in a molten state to cover said pellets with said thermoplastic composition, cooling said container so as to integrally solidify the thermoplastic composition about said pellets in said container, and sealingly fitting a lid member to said container, wherein the improvement comprises, including before said cooling step, a step of holding said container at said predetermined temperature over a predetermined period, thereby completely impregnating the individual pellets as well as interstices between pellets with said thermoplastic composition.

2. A method of producing a radio-active waste package as set forth in claim 1, wherein said improvement further comprises, before said step of sealingly fitting said lid member, a step of further filling said container with said thermoplastic composition in a molten state thereby filling a space formed in said container during said cooling step.

3. A method of producing a radio-active waste package as set forth in claim 1 or 2, wherein said improvement comprises utilizing as said thermoplastic composition an asphalt material, and said predetermined temperature is about 160° C.

4. A method of producing a radio-active waste package as set forth in claim 3, wherein said predetermined period is about one hour.

5. In a device for producing a radio-active waste package, comprising means for melting a thermoplastic composition, means for conveying a container having an open end, means for disposing into said container a predetermined volume of pellets formed from a radio-active powder which is obtained by evaporating and drying a radio-active waste, first means for heating said container containing said pellets up to a predetermined temperature, and means for supplying the molten thermoplastic composition into said container containing said pellets, the improvement which comprises second means for heating and holding said container filled with the pellets and with the thermoplastic composition at said predetermined temperature over a predetermined period, said supplying means includes a main tank filled with the molten thermoplastic composition, a cover member adapted to sealingly cover said container during the supply of said thermoplastic composition into said container, at least one nozzle piercing through said cover member and communicating with said main tank, and a vent pipe piercing through said cover member and adapted to vent a gas flowing from said container when the thermoplastic composition is supplied into said container.

6. A device for producing a radio-active waste package as set forth in claim 5, wherein said improvement further comprises supplying means further including a measuring tank through which said main tank communicates with said nozzle.

7. A device for producing a radio-active waste package as set forth in claim 6, wherein said improvement further comprises the measuring tank provided with an upper level switch and a lower level switch.

8. A device for producing a radio-active waste package as set forth in claim 5, 6 or 7, wherein said improvement further comprises means for additionally charging the thermoplastic composition into said container, thereby filling up a space formed in said container during subsequent cooling of said container after initially being supplied with said thermoplastic composition.

9. A device for producing a radio-active waste package as set forth in claim 8, wherein said additional charging means consists of a cover member adapted to sealingly cover said container filled with said pellets and the thermoplastic composition, at least one nozzle piercing said member and communicating with said main tank, and a vent pipe piercing through said cover and adapted to vent a gas flowing from said container when the thermoplastic composition is poured into said container.

10. A device for producing a radio-active waste package as set forth in claim 9, wherein said device further comprises means for controlling said supplying means so that the container may be filled with a predetermined volume of the thermoplastic composition.

11. A device for producing a radio-active waste as set forth in claim 10, wherein said device further comprises means for controlling said additional supplying means so that the thermoplastic composition may suitably fill the space formed in said container during the cooling of said container.

12. A device for producing a radio-active waste package as set forth in claim 10, wherein said controlling means includes a valve and level switches.

13. A device for producing a radio-active waste package as set forth in claim 12, wherein said controlling means further comprises means for weighing said container filled with said pellets and the thermoplastic composition.

14. A device for producing a radio-active waste package as set forth in claim 5, wherein said improvement further comprises a TV system for monitoring the filling operation of said supplying means and said additional supplying means.

* * * * *